United States Patent [19]

Sommer et al.

[11] Patent Number: 4,558,658

[45] Date of Patent: Dec. 17, 1985

[54] DEVICE FOR COATING A CONTINUOUS WEB

[75] Inventors: Herbert Sommer, Dusseldorf; Gerhard Wohlfeil, Monheim, both of Fed. Rep. of Germany

[73] Assignee: Jagenberg AG, Dusseldorf, Fed. Rep. of Germany

[21] Appl. No.: 554,520

[22] Filed: Nov. 23, 1983

[30] Foreign Application Priority Data

Feb. 21, 1983 [DE] Fed. Rep. of Germany ..... 3305966
Oct. 21, 1983 [DE] Fed. Rep. of Germany ..... 3338324

[51] Int. Cl.[4] ..... B05C 5/02
[52] U.S. Cl. ..... 118/411; 118/413
[58] Field of Search ..... 118/407, 410, 411, 413, 118/126

[56] References Cited

U.S. PATENT DOCUMENTS

| | | | |
|---|---|---|---|
| 3,169,082 | 2/1965 | Krikorean | 118/413 |
| 3,192,895 | 7/1965 | Galer | 118/413 X |
| 3,450,098 | 6/1969 | Williams, Jr. | 118/126 |
| 3,521,602 | 7/1970 | Coghill | 118/413 X |
| 4,250,211 | 2/1981 | Damrau et al. | 118/413 X |

*Primary Examiner*—John P. McIntosh

*Attorney, Agent, or Firm*—Sprung Horn Kramer & Woods

[57] ABSTRACT

A device for coating a continuous web that travels over a back-up roll. The force of application can be adjusted. The coating material is applied to the web with a slotted applicator pipe. The pipe extends over the width of the web and has a preliminary coating-material flow-regulating gap. The width of the gap can be adjusted. A coating-material flow-regulating lip and a return lip adjoin the gap in such a way as to constitute a coating-material flow-regulating chamber extending over the width of the web. The flow-regulating lip is a doctor bed and has a doctor batten that moves with little friction along at least one overflow-side slide face. The face of the doctor batten toward the web that is being coated is rectangular and demarcates in conjunction with the web a narrowing wedge-shaped gap with a geometry that depends on the degree of contact pressure. The overflow edge of the face is a straight and sharp stripping edge. The face and stripping edge of the doctor batten are flexible. Its face is highly resistant to wear. The doctor batten is forced against the web by an inflatable means of exerting contact pressure between the batten and the bed.

21 Claims, 6 Drawing Figures

DEVICE FOR COATING A CONTINUOUS WEB

BACKGROUND OF THE INVENTION

The present invention relates to a device for coating a continuous web that travels over a back-up roll, in which the force of application can be adjusted and the coating material is applied to the web with a slotted applicator pipe that extends over the width of the web and has a preliminary coating-material flow-regulating gap the width of which can be adjusted and to which a coating-material flow-regulating lip and a return lip adjoin in such a way as to constitute a coating-material flow-regulating chamber extending over the width of the web.

A device of this type is known from German Pat. No. 2 359 413 for example. The device generates an excess supply of coating material by means of a rigid but adjustable preliminary coating-material flow-regulating gap in the vicinity of the coating-material flow-regulating lip. The preliminary flow-regulating gap must be very precisely adjusted with respect to the rate at which the web is traveling and to the rheology of the coating material.

The slotted applicator pipe in another known device is mounted at a distance from the web and the coating material sprayed onto the web from below without its flow being finely regulated first. The viscosity and solids content of the coating medium are limited. It is difficult to adjust the slot in the applicator pipe precisely. The surface of the coating is also always irregular.

The flow of coating material is finely regulated upward toward the web by a separate doctor in both devices.

SUMMARY OF THE INVENTION

The object of the present invention is a device of the aforesaid type that provides a simple means of precisely varying the coating weight while maintaining highest-quality coating.

This object is attained in accordance with the invention with a device of the aforesaid type wherein (a) the flow-regulating lip has a doctor batten that moves with little friction along at least one overflow-side slide face of the doctor bed that constitutes the flow-regulating lip, (b) the face of the doctor batten toward the web that is being coated is rectangular and demarcates in conjunction with the web a narrowing wedge-shaped gap with a geometry that depends on the degree of contact pressure, (c) the overflow edge of the face constitutes a straight and sharp stripping edge, (d) the face and stripping edge of the doctor batten are flexible, (e) its face is highly resistant to wear, (f) the doctor batten is forced against the web by an elastic means of exerting contact pressure between the batten and the bed.

A doctor batten that moves with little friction allows extremely accurate control of the force with which the coating material is applied because the elastic means of exerting contact pressure acts on the flexible face and stripping edge of the doctor batten. This results in extremely uniform coating of the web. Hydrodynamic pressure is generated in the wedge-shaped gap between the geometrically stable face of the doctor batten and the web, leading to equilibrium in relation to the force of the elastic means of exerting contact pressure. The sharp stripping edge at the overflow edge of the face of the doctor batten ensures a high level of smoothness and a coating free of what are known as stress lines, whereas the face's high resistance to wear, as demonstrated by a high Vickers hardness etc., ensures long life no matter how high the contact pressure. A doctor batten shaped and mounted at the flow-regulating lip as in the invention makes redundant additional mechanisms for adjusting the contour of the doctor batten to irregularities in the back-up roll that the web travels over or along the coating width of the web.

It is practical for the coefficient of friction between the doctor batten and bed to be about $\mu \leqq 0.1$. This keeps the friction of the batten and the doctor holder negligibly low in comparison with the contact pressure exerted by the batten on the coated web.

It is practical for the doctor batten or bed, at least in the vicinity of the slide face, to be made out of steel, or coated aluminum and for the bed or batten to be made out of gunmetal that is either coated with Teflon polytetrafluoroethylene or solid nickel or hard-anode oxidized. Such pairs of material lead to the desired coefficient of friction.

It is practical for the face of the doctor batten to curve concavely as it extends from the stripping edge at least in the vicinity of that edge with a radius greater than that of the back-up roll. This design is especially practical when processing involves the application of excess coating material the volume of which is then finally regulated in a separate unit.

The face of the doctor batten can alternatively curve convexly extending from the stripping edge at least in the vicinity of the edge with a radius such that 4 mm$\leqq$R$\leqq$, $\infty$ preferably 5 mm$\leqq$R$\leqq$250 mm, and even more preferably 20 mm$\leqq$R$\leqq$50 mm. This design is for an integrated device in which the flow-regulating lip itself generates the final regulated flow.

It is practical for the face to be facet ground to approximately the radius of curvature, which is an especially simple way of shaping the face in any way desired.

It is practical for the face to be between 8 mm and 60 mm wide. The width of the face is determined by the coating weight. The higher the coating weight the lower the hydrodynamic pressure and the wider the face and hence the longer the wedge-shaped gap and the more acute the angle of the wedge in order to obtain a stable equilibrium.

To facilitate the use of doctor battens with faces that vary in width it is practical to position a spacer between the upstream surface of the doctor batten and bed.

It is practical for the slotted applicator pipe to be capable of being pivoted around the stripping edge of the doctor batten in order to vary the angle of the wedge.

The stripping edge of the doctor batten can be relief ground to improve its action even more.

To obtain the desired doctor-batten flexibility it is practical for it to have equidistant incisions along its length. The doctor batten can alternatively be made of polytetrafluoroethylene, in which case no incisions are necessary. The doctor batten can also be made out of a rubber-elastic material and the face have an antifriction insert or mount.

To protect the doctor batten from wear it is practical for the Vickers hardness of its face to be greater than 600 HV. It is practical for the face of the doctor batten to be chromed, surface- or insert-hardened, spray-coated with oxide ceramics, anodized, or, if aluminum, hard coated or solid nickled. The face of the doctor batten in one practical embodiment can also consist of an inlaid piece with high wear resistance.

It is practical for the inflatable means of exerting contact pressure, preferably a contact-pressure hose, to operate between a surface of the doctor batten that is essentially perpendicular to the slide face and another surface of the batten that is essentially parallel to the first surface.

In one preferred embodiment the means of exerting contact pressure and the doctor batten can be in one piece.

It is also practical for an inflatable means of exerting sealing pressure, preferably a sealing-pressure hose, to be positioned between the upstream surface of the doctor batten and the doctor bed. This second inflatable means of exerting pressure both prevents coating material from getting between the doctor holder and the doctor batten and enables the equilibrium obtained between the hydrodynamic pressure and the pressure in the first means of exerting pressure to be maintained by increasing the pressure in the second means of exerting pressure.

It is practical for the second means of exerting pressure and the doctor batten to be in one piece.

In another advantageous embodiment of the device in accordance with the invention the preliminary flow-regulating gap is less than 10 mm from the web being coated. The coating material can then rise into the gap between the dosing lip and the web as in a fountain.

It is practical for the back-up roll to have a rubber-elastic surface with a hardness preferably between $60 \leqq$ Shore A $\leqq 95$.

When webs are to be coated on both sides with different coats, finally, two slotted applicator pipes can be positioned with the faces of the doctor battens opposing each other with different radii of curvature. The different radii can be selected to obtain a fixed coating-weight ratio on both sides. In this case, obviously, a back-up roll to advance the web through the coating area will be neither necessary nor present. The coating weight will be the same on each side if the radii are equal.

Finally, supplementary means of exerting contact pressure can be positioned downstream from the first means in order to increase the contact pressure locally and thus compensate for irregular coating-material takeup.

Some preferred embodiments of the invention will now be described with reference to the attached drawings, wherein

DETAILED DESCRIPTION OF THE PREFERRED EMBODIMENTS

Figure 1:
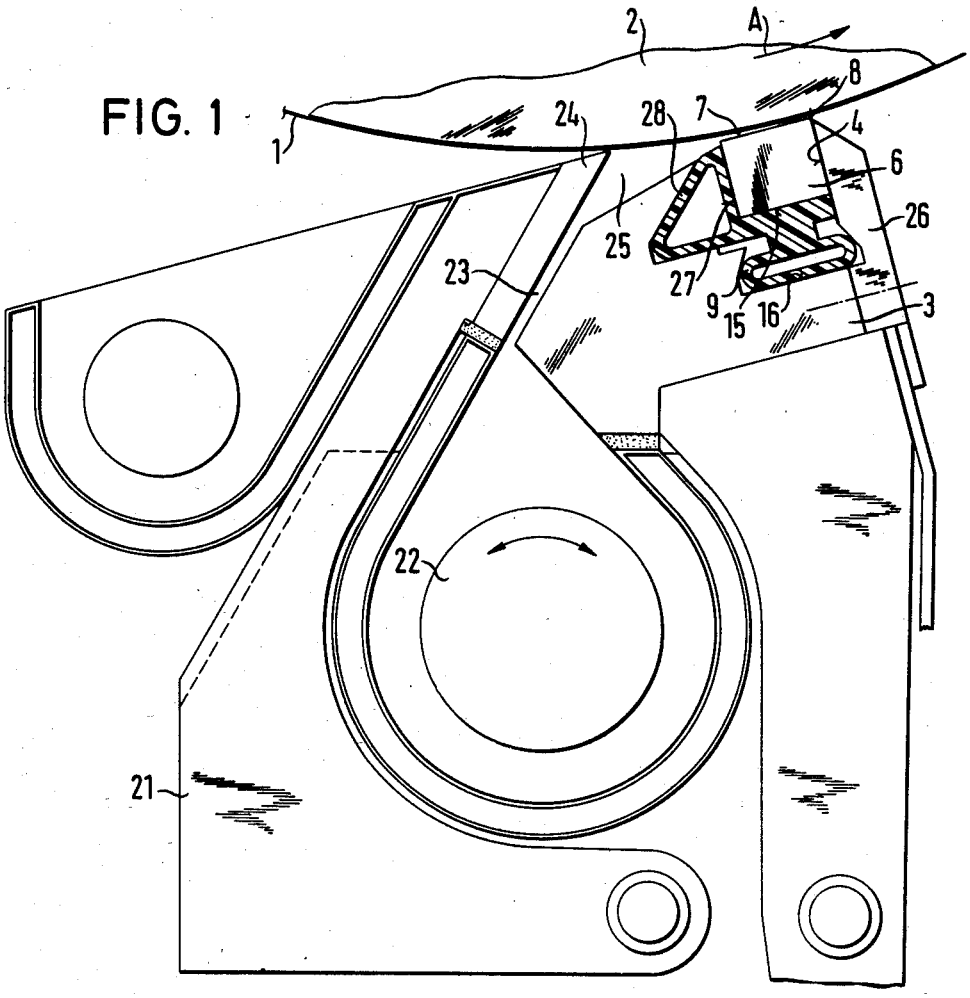
FIG. 1 is a schematic partial partly sectional view of a device in accordance with the invention.

As schematically illustrated in FIG. 1, a device for coating a continuous web 1, traveling over a back-up roll 2 in the direction indicated by arrow A, with a controlled-flow material has a slotted applicator pipe 21. Applicator pipe 21 consists of a distributing pipe 22, an elongated preliminary coating-material flow-regulating gap 23 that can be adjusted in width, a coating-material flow-regulating lip in the form of a doctor bed 3 adjoining flow-regulating gap 23, and a return lip 24 that also adjoins gap 23. The flow-regulating lip and return lip 24 constitute a coating-material flow-regulating chamber 25. Return lip 24 prevents the air-boundary layer from penetrating where the web engages slotted applicator pipe 21.

Doctor bed 3 has an advancing bar 26 with a flat slide face 4 that a doctor batten 6 rests against. Doctor batten 6 has a face 7 that is forced against coated web 1 and has a sharp stripping edge 8. An inflatable means of exerting contact pressure, in the form of a hose 9 between doctor bed 3 and doctor batten 6, allows the batten to be forced against the web 1 being coated to an extent that can be finely adjusted.

Figure 5:
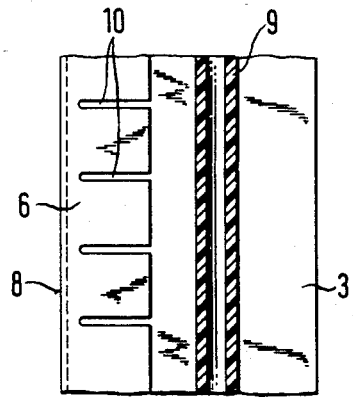
FIG. 5 is a top view of the flow-regulating lip in partial section along the line V—V in FIG. 4.

The doctor batten 6 can be freely displaced along the slide face 4 of doctor bed 3 within selectable limits, meaning that it can be unimpededly extended. Doctor batten 6 has a relatively low moment I, preferably ranging from 200 to 7000 $mm^4$, of surface inertia in the vicinity of face 7 and stripping edge 8 along an axis perpendicular to stripping edge 8 and parallel to the web 1 being coated. Such a moment of surface inertia can be obtained for example with equidistant incisions 10 along doctor batten 6, as illustrated in FIG. 5, with the cross-section of the batten remaining constant as measured over its total length up to a slight distance from stripping edge 8. The resulting flexibility of doctor batten 6 can alternatively be obtained by selecting an appropriate material to make it out of or by making it less thick.

The face 7 of doctor batten 6 curves convexly or concavely as it extends from stripping edge 8. In the preferred embodiments illustrated, face 7 has either a concave contour with a radius R of curvature longer than that of back-up roll 2 (as is preferable when the coating material is applied in excess and its volume regulated subsequently by a separate unit) or a convex contour with a radius R of curvature such that 4 mm $\leqq R \leqq \infty$, preferably 5 mm $\leqq R \leqq$ 250 mm, and even more preferably 20 mm $\leqq R \leqq$ 50 mm (as is preferable when the flow of coating material is regulated in one integrated unit). The radius R actually selected will depend on the desired range of coating weight and the rheological properties of the coating medium.

The surface of doctor batten 6 also has a Vickers hardness of more than 600 HV, at least in the vicinity of curved face 7 to keep the face resistant to wear. The face 7 of doctor batten 6 can be chromed, surface- or insert-hardened, spray-coated with oxide ceramics, anodized, or, if aluminum, hard coated or solid nickled for this purpose.

The stripping edge 8 of doctor batten 6 is absolutely straight and sharp, resulting in a coating that has extraordinarily satisfactory smoothness. Stripping can be further improved by relief-grinding stripping edge 8 for example.

Another means of improving the wear resistance of the face 7 of doctor batten 6 is by making it out of a highly resistant inlay.

An inflatable means of exerting sealing pressure, preferably a sealing-pressure hose 28, is positioned between the upstream surface of the doctor batten 6 and the doctor bed 3, sealing the bed off from the batten and maintaining the stable position of the batten obtained by increasing the pressure.

The geometry of the face 7 of doctor batten 6 is always constant in the embodiment being described no matter what the contact pressure. Since contact pressure is, in addition to the design of face 7, the length of radius R, that is, and to web speed, to the rheology of the coating medium, and to the physical properties of the web, a significant parameter, the quality of the coating can be kept absolutely constant at various contact pressures.

The inflatable means of exerting contact pressure employed in the embodiment being described is a contact-pressure hose 9 charged with air. The flexibility of the hose 9 ensures uniform compression of doctor batten 6 against the web 1 traveling over back-up roll 2 over the total operating width. The linear pressure exerted by the hose maintains equilibrium with the hydrodynamic pressure below the face 7 of doctor batten 6 in the wedge-shaped gap. Varying the pressure in the hose will accordingly result in extremely fine, uniform, and continuous adjustment of coating weight, with the same equilibrium between hydrodynamic pressure and doctor-contact pressure occurring at every point along the operating width without any additional contouring mechanism. This is the premise for a uniform coating depth.

Contact-pressure hose 9 is designed in such a way that its forces will apply only to the rear surface 15 of doctor batten 6 and to a sealing insert 16 that is essentially parallel to surface 15 in doctor bed 3. Sealing-pressure hose 28 presses against the surface 27 of doctor batten 6 and will maintain doctor batten 6 in a position that has been previously obtained when pressure is high enough.

Pressure hoses 9 and 28, and doctor batten 6 as well if necessary, can be in one piece, although it must be ensured that the resulting unit is flexible enough and that face 7 is sufficiently wear-resistant.

The selection of pairs of materials for doctor bed 3 or feeding bar 26 and doctor batten 6 must be made in such a way that the forces of friction that occur during the displacement of doctor batten 6 and that could counteract the contact pressure exerted by hose 9 and thus lead to hysteresis in controlling coating weight be kept as low as possible. Unavoidable shearing strains in preliminary coating-material flow-regulating gap 23 generate normal forces on doctor batten 6 with which the air pressure in hose 9 maintains equilibrium. If the coefficient $\mu$ of friction between doctor batten 6 and doctor bed 3 or feeding bar 26 is less than or equal to 0.1, the resulting forces of friction will be negligible in relation to the force of contact pressure.

Figure 2:
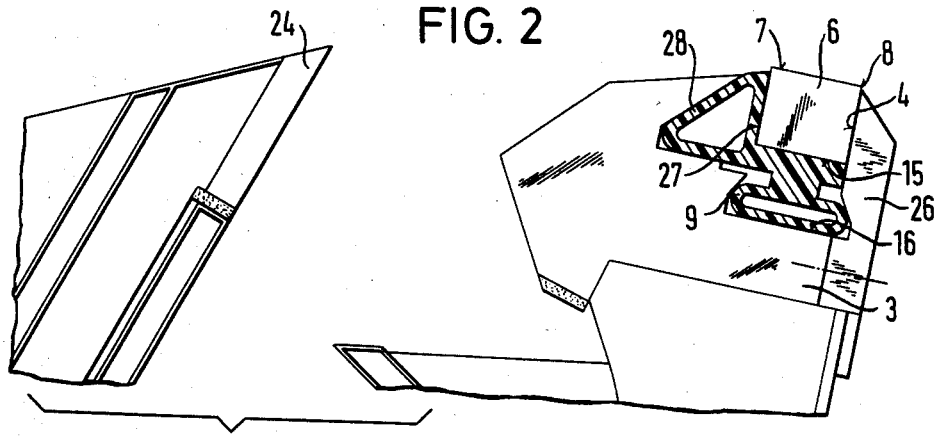
FIG. 2 is a partial side view of the device in FIG. 1 with the flow-regulating lip pivoted out.

It is practical for slotted applicator pipe 21 to be capable of pivoting around stripping edge 8 so that the wedge-shaped gap between face 7 and web 1 can be adjusted. It is also practical for the flow-regulating lip constituted by doctor bed 3 to be capable of beihg completely swung out. FIG. 2 illustrates it in the swung-out position.

Figure 3:
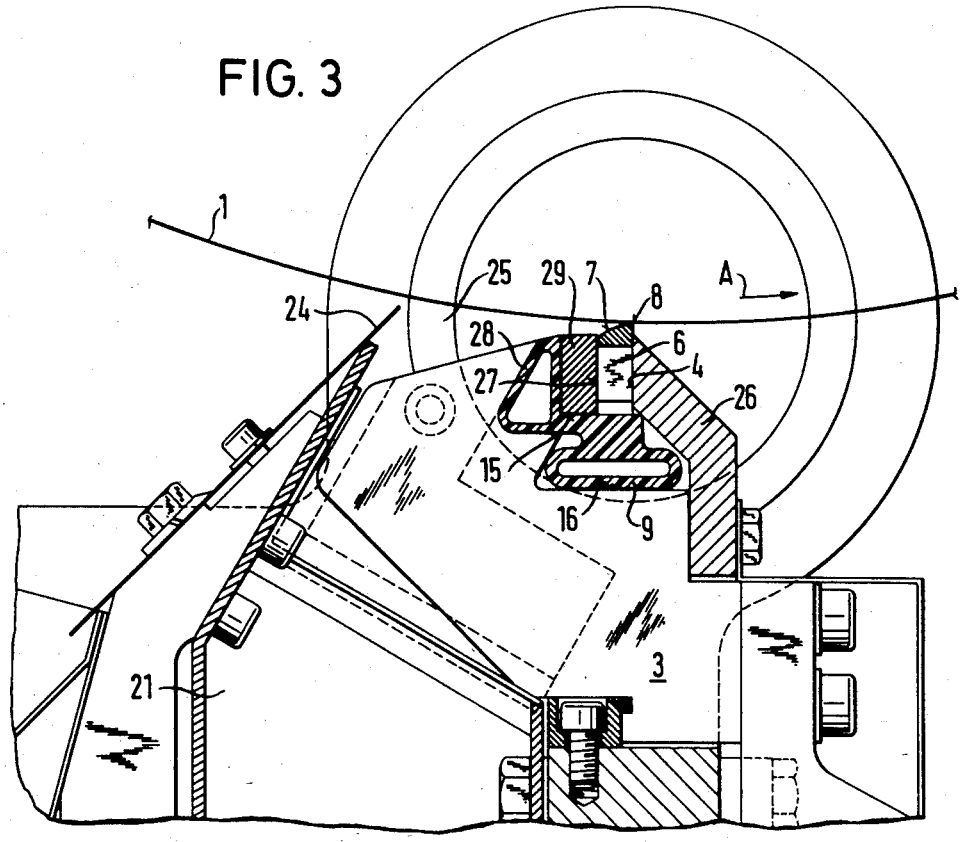
FIG. 3 is a schematic partial partly sectional view of a modified device in accordance with the invention.

FIG. 3 illustrates an embodiment of the device in accordance with the invention in which doctor batten 6 is relatively narrow. This embodiment also has a spacer 29 that allows the narrower batten to be employed instead of a wider one.

Figure 4:
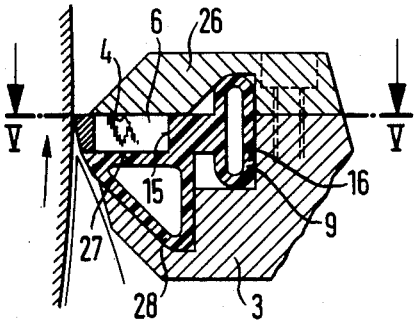
FIG. 4 is a partly sectional view of a flow-regulating lip in a device in accordance with the invention.

Only a narrow doctor batten 6 can be employed in the embodiment of flow-regulating lip or doctor holder 3 illustrated in FIGS. 4 and 5.

Figure 6:
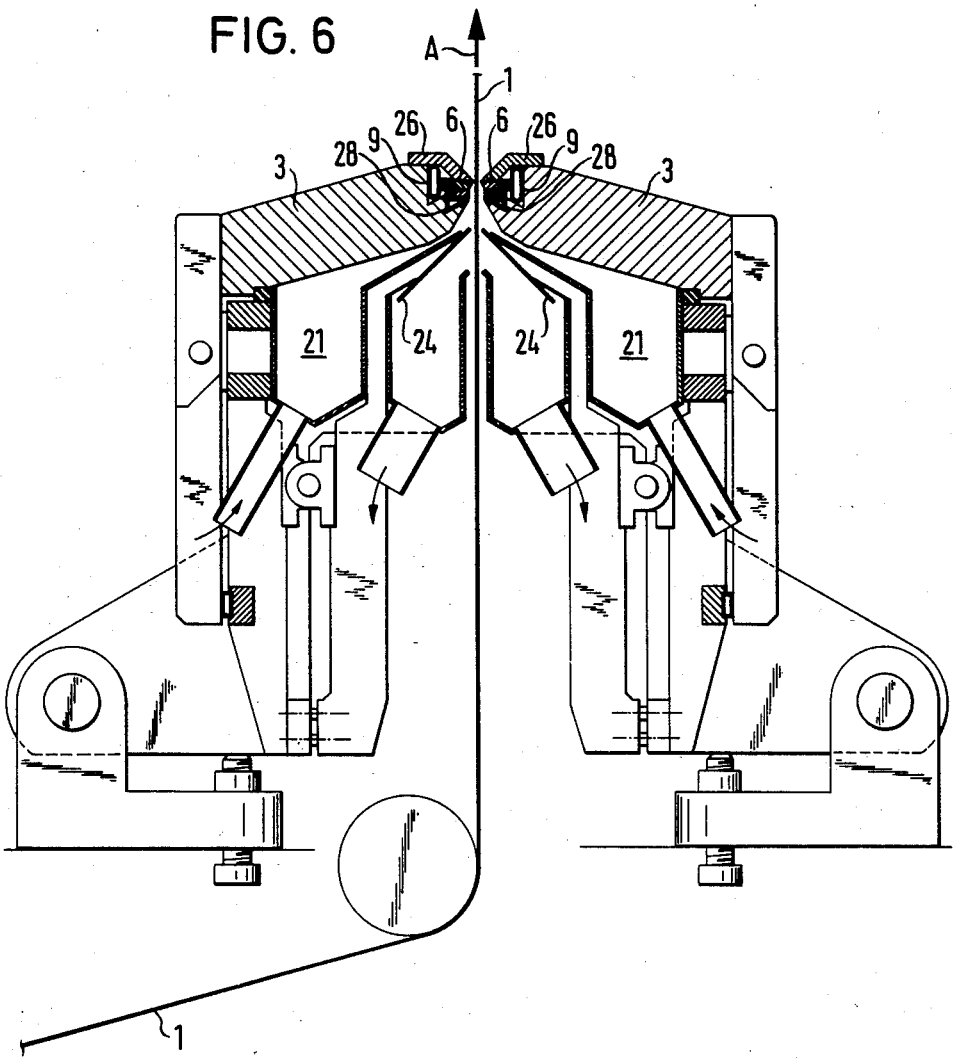
FIG. 6 is a schematic view of a device in accordance with the invention for simultaneously coating both sides of a web.

FIG. 6 illustrates an embodiment for coating a web 1 on both sides. It includes instead of a back-up roll a second slotted appicator pipe 21 positioned in relation to the first pipe 21 in such a way that the faces 7 of each doctor batten 6 oppose each other and the stripping edges 8 of each batten 6 contact web 1 at the same level. Different coating weights can be obtained by varying the radii of curvature of faces 7.

It is understood that the specification and examples are illustrative but not limitative of the present invention and that other embodiments within the spirit and scope of the invention will suggest themselves to those skilled in the art.

We claim:

1. In a device for coating a continuous web which travels over a backing member, in which device the force of application can be adjusted, comprising a slotted pipe for applying the coating material to the web, the slotted applicator pipe extending over the width of the web and having a preliminary coating-material flow-regulating gap the width of which can be adjusted, a coating-material flow regulating lip and a return lip adjoining the slotted applicator pipe in such a way as to constitute a coating-material flow-regulating chamber extending over the width of the web, the improvement wherein (a) the flow-regulating lip has a doctor batten that moves with little friction along at least one overflow-side slide face of a doctor bed that constitutes the flow-regulating lip, (b) the face of the doctor batten toward the web that is being coated is rectangular and has an overflow edge and in conjunction with the web defining a narrowing wedge-shaped gap with a geometry that depends on the degree of contact pressure, (c) the overflow edge of the face of the doctor batten constitutes a straight and sharp stripping edge, (d) the face and stripping edge of the doctor batten are flexible, (e) the face is highly resistant to wear, (f) the doctor batten is forced against the web by an elastic means of exerting contact pressure between the batten and the bed, and (g) the device includes a support for the batten permitting movement of at least portions of the flexible batten toward and away from the backing member across the machine width so that the flexible batten is free to adjust the changes in what it confronts.

2. A device according to claim 1, wherein the coefficient of friction between the doctor batten and doctor bed is about $\mu \leqq 0.1$.

3. A device according to claim 2, wherein in the vicinity of the slide face one of the doctor batten and doctor bed is made out of one of steel, and coated aluminum and the other is made out of gun metal that is one of coated with polytetrafluoroethylene, coated with solid nickel and hard-anode oxidized.

4. A device according to claim 1, wherein the face of the doctor batten curves concavely as it extends from the stripping edge at least in the vicinity of that edge with a radius (R) greater than that of a back-up roll over which the web travels.

5. A device according to claim 4, wherein the face is facet ground to approximately the radius of curvature.

6. A device according to claim 1, wherein the face of the doctor batten curves convexly extending from the stripping edge at least in the vicinity of the edge with a radius (R) such that $4\ mm \leqq R \leqq \infty$.

7. A device according to claim 1, wherein the face is between about 8 mm and 60 mm wide.

8. A device according to claim 1, including a spacer positioned between the upstream surface of the doctor batten and the doctor bed.

9. A device according to claim 1, wherein the slotted applicator pipe is pivoted around the stripping edge of the doctor batten.

10. A device according to claim 1, wherein the stripping edge of the doctor batten is relief ground.

11. A device according to claim 1, wherein the doctor-batten has equidistant incisions along its length.

12. A device according to claim 1, wherein the doctor batten is made of polytetrafluoroethylene.

13. A device according to claim 1, wherein the doctor batten is made of a rubber-elastic material.

14. A device according to claim 1, wherein the Vickers hardness of the face of the doctor batten is greater than 600 HV.

15. A device according to claim 1, wherein the face of the doctor batten is one of chromed, surface-hardened, insert-hardened, spray-coated with an oxide ceramic, anodized, hard coated, and solid nickled aluminum.

16. A device according to claim 1, wherein the face of the doctor batten is an inlaid piece with high wear resistance.

17. A device according to claim 1, wherein the elastic means of exerting contact pressure comprises an inflatable hose operating between a surface of the doctor batten that is essentially perpendicular to the slide face and another surface of the batten that is essentially parallel to the first surface.

18. A device according to claim 1, including an inflatable means of exerting sealing pressure positioned between the upstream surface of the doctor batten and the doctor bed.

19. A device according to claim 18, wherein the inflatable means of exerting sealing pressure is a sealing-pressure hose.

20. A device according to claim 1, including a back-up roll over which the web travels, the back-up roll having a rubber-elastic surface with a hardness between about 60 and 95 Shore A.

21. A device according to claim 1, including a second slotted applicator pipe positioned so that the faces of the doctor battens oppose each other, thereby to be able to coat both sides of the web.

* * * * *